United States Patent [19]

Oya et al.

[11] 4,206,179

[45] Jun. 3, 1980

[54] APPARATUS FOR PURIFYING EXHAUST GASES OF INTERNAL COMBUSTION ENGINES

[75] Inventors: Hiroo Ōya, Ohta; Ojimamachi Kakinuma, Gunma, both of Japan

[73] Assignee: Fuji Jukogyo Kabushiki Kaisha, Tokyo, Japan

[21] Appl. No.: 913,028

[22] Filed: Jun. 6, 1978

[30] Foreign Application Priority Data

| | | | |
|---|---|---|---|
| Apr. 8, 1978 | [JP] | Japan | 53-41511 |
| Apr. 8, 1978 | [JP] | Japan | 53-41512 |
| Apr. 8, 1978 | [JP] | Japan | 53-41513 |
| Apr. 8, 1978 | [JP] | Japan | 53-41515 |

[51] Int. Cl.[2] ..... B01J 35/04; B01J 8/02; F01N 3/15

[52] U.S. Cl. ..... 422/180; 422/176; 422/179

[58] Field of Search ..... 23/288 F, 288 FC; 422/176, 179, 180; 60/282, 293, 299, 301, 302

[56] References Cited

U.S. PATENT DOCUMENTS

| | | | |
|---|---|---|---|
| 3,307,920 | 3/1967 | Barnes | 23/288 F |
| 3,780,772 | 12/1973 | Carnanhan et al. | 23/288 FC UX |
| 3,817,714 | 6/1974 | Wiley | 23/288 FC |
| 3,841,842 | 10/1974 | Wiley | 23/288 FC |
| 3,854,888 | 12/1974 | Frietzsche et al. | 23/288 FC |
| 3,912,459 | 10/1975 | Kearsley | 422/179 |
| 3,938,959 | 2/1976 | Matsui et al. | 23/288 FC |
| 3,978,567 | 9/1976 | Vroman | 23/288 FC X |
| 4,002,433 | 1/1977 | Oser | 23/288 FC |
| 4,043,761 | 8/1977 | Gaysert et al. | 23/288 FC |

FOREIGN PATENT DOCUMENTS

| | | | |
|---|---|---|---|
| 968970 | 6/1975 | Canada | 60/299 |
| 2311475 | 10/1973 | Fed. Rep. of Germany | 23/288 FC |
| 2341527 | 3/1974 | Fed. Rep. of Germany | 23/288 FC |
| 2307215 | 8/1974 | Fed. Rep. of Germany | 23/288 FC |
| 2308721 | 8/1974 | Fed. Rep. of Germany | 422/180 |
| 2412863 | 10/1974 | Fed. Rep. of Germany | 23/288 FC |
| 2341265 | 3/1975 | Fed. Rep. of Germany | 23/288 FC |
| 2364425 | 7/1975 | Fed. Rep. of Germany | 23/288 FC |
| 2604886 | 8/1977 | Fed. Rep. of Germany | 23/288 FC |
| 1357241 | 6/1974 | United Kingdom | 60/302 |
| 1437315 | 5/1976 | United Kingdom | 23/288 FC |

*Primary Examiner*—Barry S. Richman
*Attorney, Agent, or Firm*—Martin A. Farber

[57] ABSTRACT

Apparatus for purifying the exhaust gases of internal combustion engines comprising a pair of upstream exhaust pipes, a catalytic converter, and a downstream exhaust pipe. The catalytic converter comprises a shell having an inlet chamber, catalyst chamber, and an outlet chamber. The axial lines of the inlet ports are arranged to cross each other in the inlet chamber at a position near, but upstream of, the upstream facing end of said monolithic catalyst element, so that gas flow can diffuse to the entire plane of the element.

2 Claims, 9 Drawing Figures

APPARATUS FOR PURIFYING EXHAUST GASES OF INTERNAL COMBUSTION ENGINES

BACKGROUND OF THE INVENTION

The present invention relates to apparatus for purifying exhaust gases of internal combustion engines of automotive vehicles.

There are three kinds of catalytic converters, namely, a reducing catalytic converter for elimination of nitrogen oxides, an oxidizing catalytic converter for elimination of carbon monoxide and hydrocarbons, and three-way converter for reacting the three noxious elements at the same time. The converters comprise a catalyst bed comprising a pellet type catalyst element or monolithic or honeycomb catalyst element. The monolithic catalyst element has a series of longitudinally oriented passages, so that exhaust gases may flow smoothly through the catalyst element. However, there is a problem that reaction may not be sufficiently carried out to reduce each noxious component to the required level because of short residence time of the gas flow.

To remove the problem, there devices have been proposed for increasing the residence time of the gas flow in the converter, for example, devices where the discharge end portion of the exhaust pipe is deformed to restrict or diffuse the gas flow or a perforated plate is provided in front of the catalyst element to diffuse the gas flow and reduce the flow rate. However, these device have disadvantage that back pressure is increased by the restriction of the gas flow, which decreases the output of the engine.

Further, in the conventional catalytic converter, the axial line of the inlet port is arranged to make a right angle with the front plane of the catalyst element at the central portion thereof. Although the inlet port communicates the catalyst element through the cone-shaped guide duct, the exhaust gas flow cannot sufficiently diffuse up to the entire front plane of the catalyst element and hence has a tendency to collect in the central portion of the front plane. Consequently, the central portion is heated at a high temperature resulting in early damage to the portion.

Therefore, it is the object of the present invention to provide a monolithic type catalytic converter in which the exhaust gas may be diffused and slowed down without an increase in the back pressure and may flow uniformly passing through all passages of the catalyst element, thereby to effect sufficient oxidation of the noxious components.

SUMMARY OF THE INVENTION

In accordance with the present invention, the apparatus comprises a pair of upstream exhaust pipes, a catalytic converter communicating with to the exhaust pipes, and a downstream exhaust pipe communicating with to the catalytic converter. The catalytic converter comprises a shell defining an inlet chamber and a catalyst chamber and an outlet chamber, the monolithic catalyst element being resiliently mounted in the catalyst chamber. The inlet chamber has two inlet ports which communicate with the upstream exhaust pipes respectively, and the outlet chamber has an outlet port communicating with to the downstream exhaust pipe. The axial lines of the inlet ports are arranged to cross each other in the inlet chamber at a position near, but upstream of, the upstream facing end of the monolithic catalyst element so that gas flow entering the converter may diffuse to the entire front plane of the catalyst element. Further, the part of a shell between both inlet ports is formed into the saddlebacked shape, whereby diffusion of the gas flow is promoted.

Other objects and advantages will be apparent as the present invention is hereinafter described in detail referring to the accompanying drawings, in which:

FIG. 1 is a plan view of an apparatus embodying the present invention,

FIG. 2 is a sectional plan view of the catalytic converter shown in FIG. 1, FIG. 3 is a side view of the catalytic converter, FIG. 4 is a perspective view of shells of the catalytic converter with the parts shown in disassembled relation, FIG. 5 is a sectional view taken along the line V—V in FIG. 2, FIG. 6 is a sectional view taken along line VI—VI in FIG. 2, FIG. 7 is a sectional plan view of an inlet chamber portion, FIG. 8 is a sectional view showing a stud, and FIG. 9 is an end elevational view at an enlarged scale as seen from the right in FIG. 1.

DETAILED DESCRIPTION OF THE INVENTION

Figure 1:
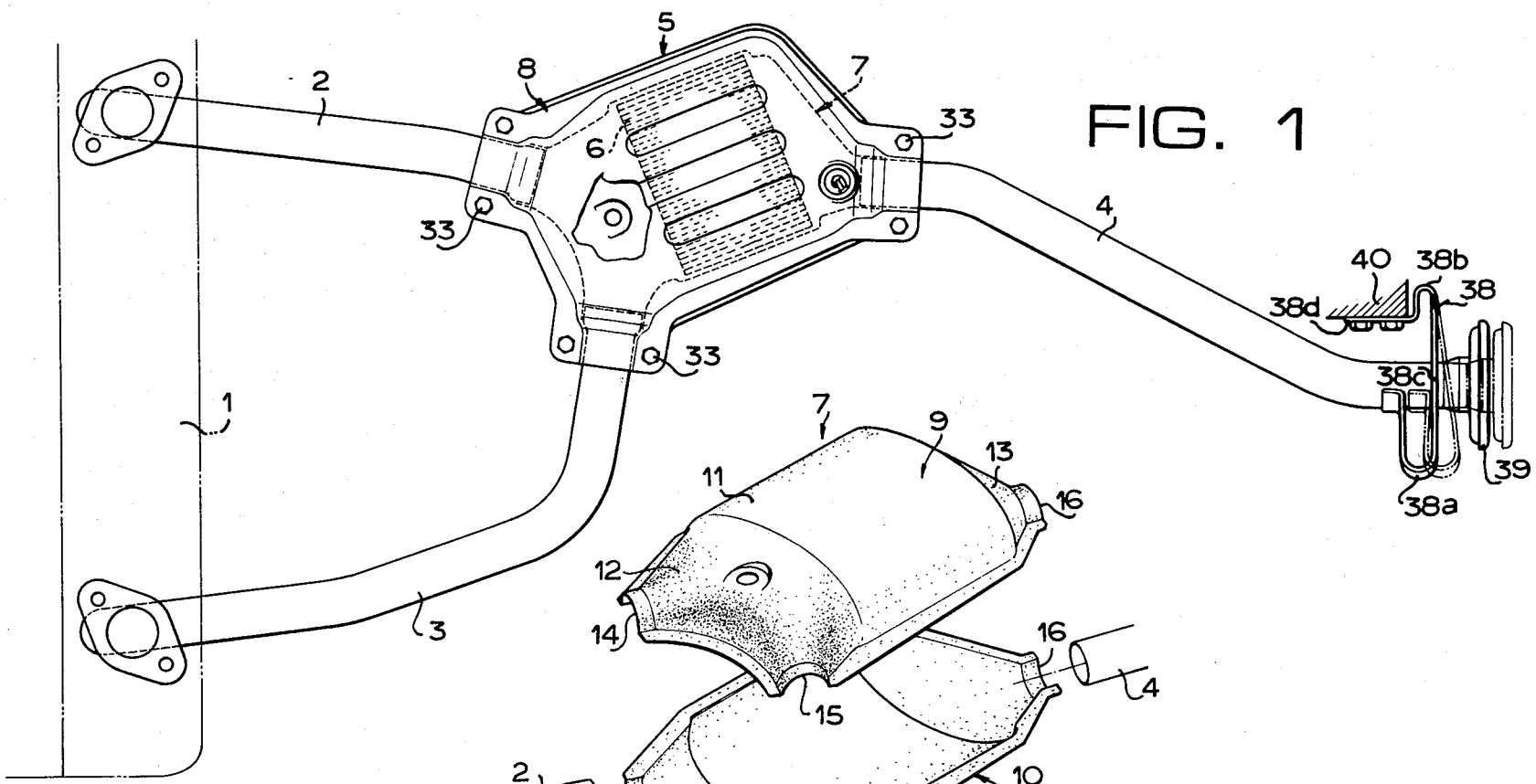
Figure 4:
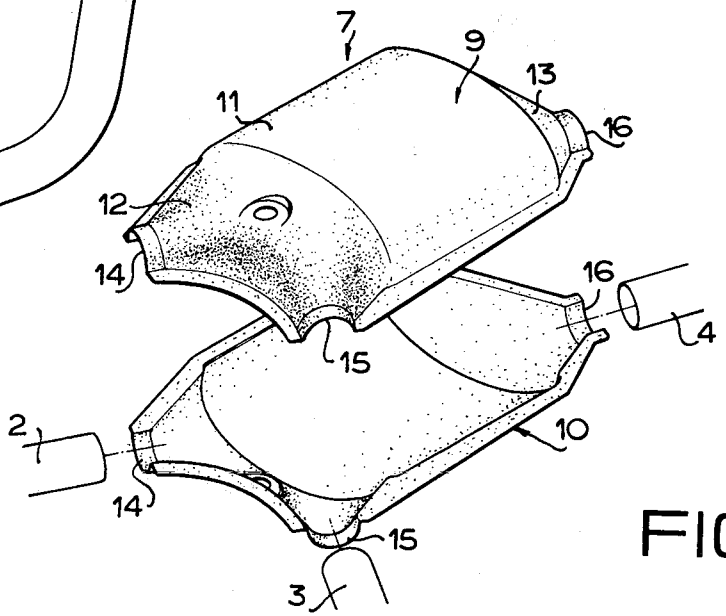
Figure 2:
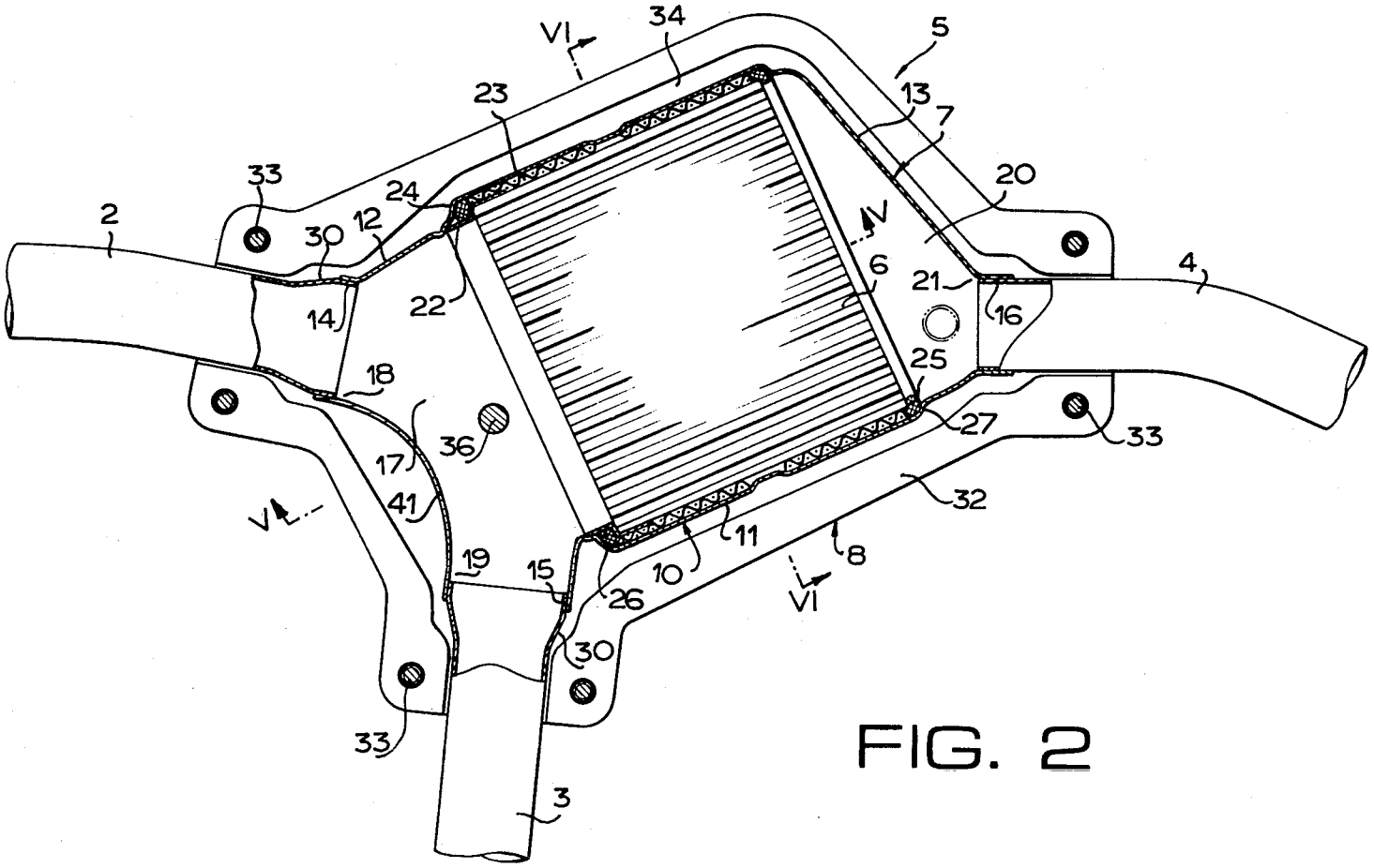
Figure 3:
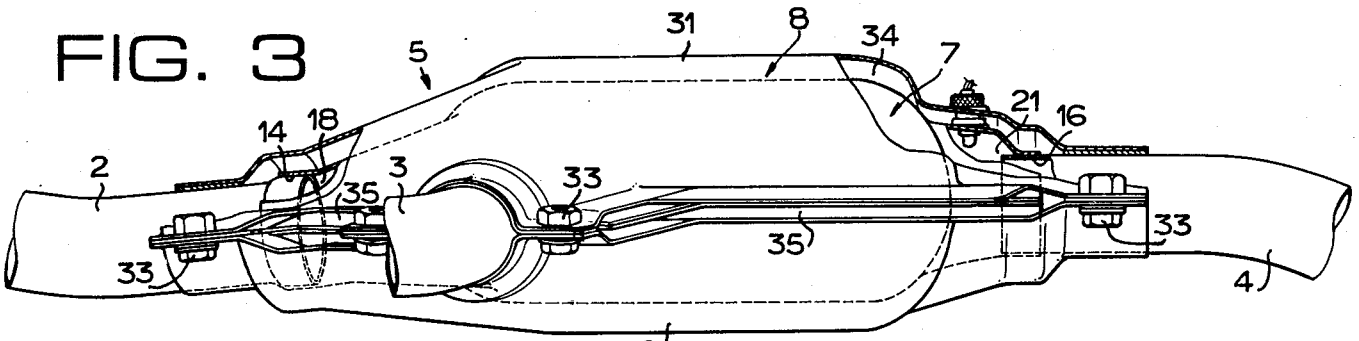
Figure 5:
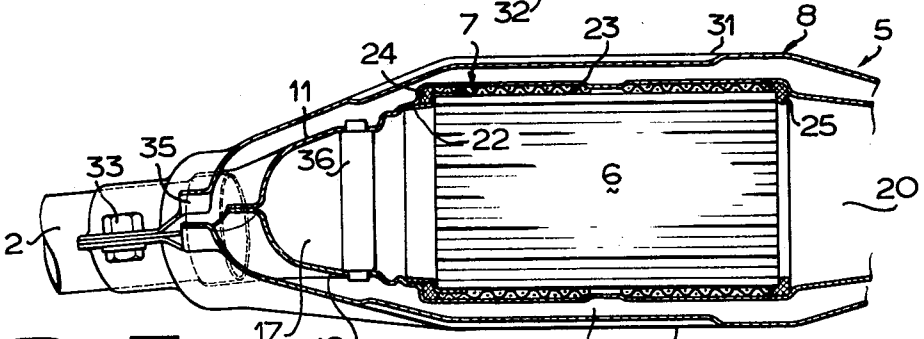
Figure 6:
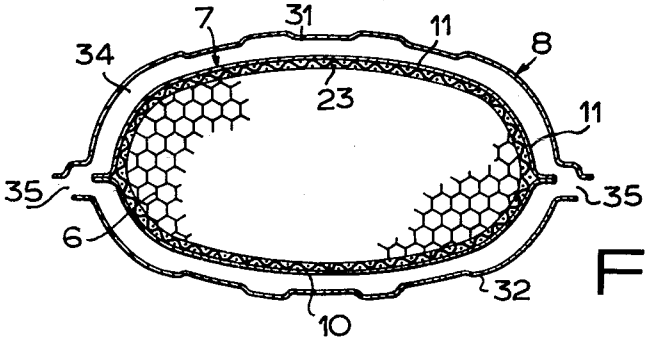

Referring to FIG. 1, an exhaust system in which the catalytic converter of the present invention is applied comprises a bifurcated exhaust pipe comprising two upstream exhaust pipes 2 and 3 connected to a pair of exhaust ports of the engine 1 and a common downstream exhaust pipe 4. Such a bifurcated exhaust pipe, for example, is used in the horizontal opposed-cylinder type engine. At the concourse portion or bifurcation of the exhaust pipes, a catalytic converter 5 of the present invention is provided, connecting each end of the exhaust pipes 2 and 3 to an inlet of the catalytic converter and connecting the end of the common exhaust pipe 4 to an outlet thereof.

The catalytic converter 5 comprises a monolithic catalyst element 6 provided in a cylindrical shell 7 having an oval cross section and a protective cover 8, as shown in FIGS. 2 to 6. The catalyst is a monolithic three-way catalyst, but other types of catalyst may be used as the converter. The shell 7 comprises a pair of half shells 9 and 10 each of which is made by pressing stainless steel plate. Each of the half shells 9 and 10 has a body shell 11, a tapered inlet shell 12, and a tapered outlet shell 13. The inlet shell 12 has a pair of semicircular inlet portions 14 and 15, and the outlet shell 13 has a semicircular outlet portion 16. Thus, by joining both half shells 9 and 10 together, a catalyst chamber is formed by the body shells 11, an inlet chamber 17 is formed by the tapered inlet shells 12, and inlet ports 18 and 19 are formed by the semicircular inlet portions 14 and 15. Further, an outlet chamber 20 is formed by the tapered outlet shells 13 and an outlet port 21 is formed by the semicircular outlet portions 16. Each axial line of the inlet ports 18 and 19 has forms an oblique or acute angle with the front plane of the catalyst element, so that the obliquely cross section of a inlet port may substantially correspond to the oval shape of the front end plane of the catalyst element. Further, the outlet port 21 is biased from the axial line of the catalyst chamber and makes an angle with the axial line. The part 41 of the inlet shell 12 between the inlet ports is formed into a saddlebacked shape.

In assembly, the monolithic catalyst element 6 engages an annular rim 22 and is wrapped with a wire mesh 23 and damper meshes 24 and 25, and the wrapped catalyst element 6 engages with one of the half shells 9 and 10 and the half shelfs are joined and welded to each other. The damper mesh 24 is disposed between the shoulder 26 of the body shell 11 and the annular rim 22, and the damper mesh 25 is disposed between the shoulder 27 of the shell and the end of the catalyst element. Thus, the monolithic catalyst element 6 is resiliently maintained by the wire mesh 23 and the damper meshes 24 and 25, so that movement of the catalyst member is prevented and the damper mesh 24 and the annular rim 22 serve as a sealing device for preventing the exhaust gases from passing through the space between the catalyst element and the inner wall of the shell 7.

Figure 7:
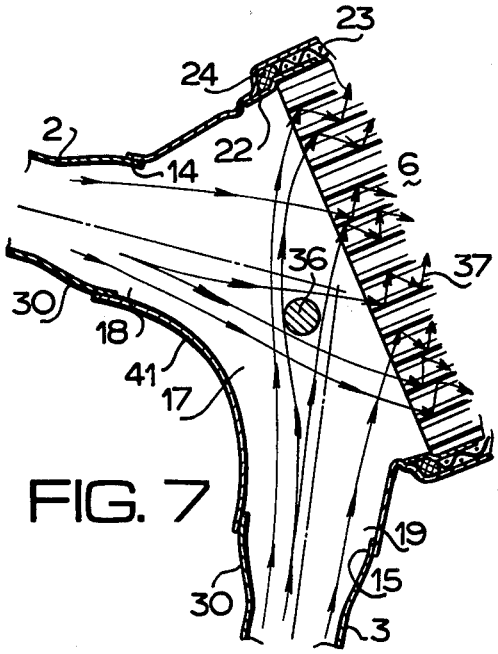
Figure 8:
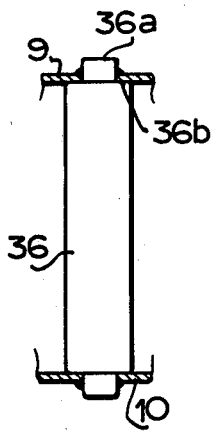
Figure 9:
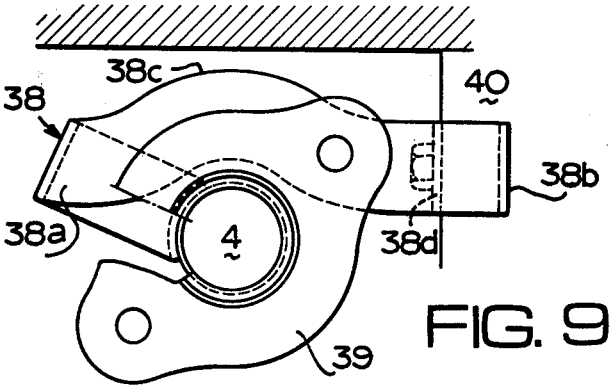

The upstream exhaust pipes 2 and 3 engage with the inlet ports 18 and 19 and are welded thereto, respectively and the downstream exhaust pipe 4 engages with the outlet port 21. End portion of the each upstream exhaust pipe is expanded in diameter as shown by numeral 30 in FIGS. 2 and 7, whereby the expanded portion serves as a device for diffusing the exhaust gas flow. The converter shell 7 is covered by the protective cover 8 comprising half members 31 and 32. The half members 31 and 32 are joined at the portion surrounding the exhaust pipes 2, 3 and 4 and secured thereto by bolts 33. Peripheral edges of both half members 31 and 32 are disposed apart from each other and a space 34 between is provided the cover 8 and the shell 7. Thus, air may enters into the space 34 from the gap 35 between the edges of the half members 31 and 32, thereby cooling the converter during the operation. Further, a reinforcement stud 36 is provided in the inlet chamber 17. The stud 36 has reduced diameter portion **36*a* and shoulder 36*b* at the opposite ends. Each reduced diameter portion 36*a* engages a hole of the half shell and the shoulder 36*b* supports the half shell, and the portion 36*a* and the half shell are welded to each other. Further, the stud 36 is positioned at a point which is at some distance in the upstream direction from the crossing point of the axial lines of the inlet ports 18 and 19 as shown in FIG. 7. Thus, the exhaust gas flow from both of the inlet ports 18 and 19 is diffused by the stud 36**.

In operation, exhaust gases enter into the inlet chamber 17 from the inlet ports 18 and 19 alternately in accordance with the firing order of the engine. Since each axial line of the inlet ports makes an oblique angle with the end plane of the catalyst element 6, the oblique cross section of the inlet port may substantially correspond to the oval front plane of the catalyst element, whereby the gas flow can diffuse to the entire front plane of the element. Therefore, a uniform flow in the catalyst element may be expected. Further, the saddlebacked shaped part 41 promotes the diffusion of the gas flow. In addition, the exhaust gases pass through each passage of the catalyst element with a zigzag flow pattern as shown by arrows 37 in FIG. 7, because the exhaust gases enter into the passage making an angle with the axial line of the passage. The zigzag flow pattern will increase the residence time of the gases in the catalyst element to enhance the converter in which the gases pass straight through the passage. Thus, in accordance with the present invention, a sufficient residence time and a uniform flow of the exhaust gases in the catalyst element may be obtained to reduce the amount of noxious components to the required level without an increase of the back pressure.

In order to provide the cylindrical shell 7 having a pair of inlet ports 18 and 19 by press working of steel plate, it is preferable to combine the half shells 9 and 10 as in the above described embodiment. However, it is difficult to make such a half shell by pressing the steel plate with accuracy.

Accordingly, the combined cylindrical shell 7 is liable to have a comparatively large dimensional error. If the gap between the shell 7 and the catalyst element is larger than the tolerance of the converter, the sealing effect of the damper mesh will decrease and the exhaust gases will pass through the gap without contact with the catalyst element. To remove such a defect, the half shells 9 and 10 are supported in the desired position by the stud 36.

Further, the exhaust pipe structure of the embodiment is attached to the car body by a resilient bracket 38 at the end of the exhaust pipe 4 to allowing of movement of the structure caused by thermal expansion, shock transmitted from the car body, and so on. The bracket 38 is made of an elongated resilient steel plate and has an end welded to the exhaust pipe 4 at the position near the flange 39 to be connected to a muffler (not shown), U-shaped bent portions **38*a* and 38*b*, a horizontal portion 38*c* disposed above the exhaust pipe and crossing the pipe, and the other end 38*d* secured to the car body 40. The U-shaped bent resilient portions 38*a* and 38*b* are disposed on opposite sides of the exhaust pipe as viewed from the upper portion of the drawing of FIG. 1. Accordingly, the axial movement of the exhaust pipe structure comprising the exhaust pipes 2, 3, 4 and the converter 5 can be absorbed by bending of the resilient portions 38*a* and 38*b***.

What is claimed is:

1. Apparatus for purifying the exhaust gases of internal combustion engines of automotive vehicles comprising a pair of upstream exhaust pipes adapted to communicate with exhaust ports on an internal combustion engine, a catalytic converter communicating with said exhaust pipes, and a downstream exhaust pipe communicating with said catalytic converter, said catalytic converter comprising a shell forming an inlet chamber, a catalyst chamber having an oval cross-section and an outlet chamber, and a monolithic catalyst element in said catalyst chamber, said inlet chamber having a pair of inlet ports engaged with said upstream exhaust pipes, the axial line of each said inlet ports forming an oblique angle with the front plane of said catalyst element so that the projection of each inlet port onto the front plane of said catalyst element substantially corresponds to the oval shape of the front plane of said catalyst element, said inlet ports being so arranged that the axial lines of the inlet ports cross each other in said inlet chamber at a position near, but upstream of the upstream facing end of said monolithic catalyst element, the part of said shell between said both inlet ports having a saddle-backed shape.

2. Apparatus for purifying the exhaust gases as of internal combustion engines of automotive vehicles comprising a pair of upstream exhaust pipes adapted to communicate with exhaust ports on an internal combustion engine, a catalytic converter communicating with said exhaust pipes, and a downstream exhaust pipe communicating with said catalytic converter, said catalytic converter comprising a shell forming an inlet chamber, a catalyst chamber having an oval cross-section and an outlet chamber, and a monolithic catalyst element in said catalyst chamber, said inlet chamber having a pair of inlet ports engaged with said upstream exhaust pipes, the axial line of each said inlet ports forming an oblique angle with the front plane of said catalyst element so that the projection of each inlet port onto the front plane of said catalyst element substantially corresponds to the oval shape of the front plane of said catalyst element, said inlet ports being so arranged that the axial lines of the inlet ports cross each other in said inlet chamber at a position near, but upstream of the upstream facing end of said monolithic catalyst element, each of said upstream exhaust pipes having an expanded end portion so as to serve as means for diffusing the exhaust gases discharged from the end.

* * * * *